US008522409B2

(12) United States Patent
Uehara et al.

(10) Patent No.: US 8,522,409 B2
(45) Date of Patent: Sep. 3, 2013

(54) SIDE RELEASE BUCKLE

(71) Applicant: YKK Corporation, Tokyo (JP)

(72) Inventors: Ryoichiro Uehara, Toyama (JP); Yasutaka Nishida, Tokyo (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/647,341

(22) Filed: Oct. 8, 2012

(65) Prior Publication Data

US 2013/0031754 A1 Feb. 7, 2013

Related U.S. Application Data

(63) Continuation of application No. 13/258,203, filed as application No. PCT/JP2009/056634 on Mar. 31, 2009.

(51) Int. Cl.
*A44B 99/00* (2010.01)

(52) U.S. Cl.
USPC ..... 24/615; 24/DIG. 51; 24/604; 24/616; 24/609; 24/611; 24/612

(58) Field of Classification Search
None
See application file for complete search history.

(56) References Cited

U.S. PATENT DOCUMENTS

| | | | | |
|---|---|---|---|---|
| 5,465,472 | A | 11/1995 | Matoba | |
| 5,546,642 | A | 8/1996 | Anscher | |
| 5,791,026 | A | 8/1998 | Anscher | |
| 6,052,875 | A | 4/2000 | Fudaki | |
| 6,148,486 | A | 11/2000 | Uehara et al. | |
| D471,486 | S | 3/2003 | Uehara et al. | |
| D483,293 | S * | 12/2003 | Kawamura | D11/216 |
| 6,728,999 | B2 | 5/2004 | Murai et al. | |
| D496,302 | S * | 9/2004 | Kaneko et al. | D11/216 |
| 7,024,734 | B2 * | 4/2006 | Anscher | 24/625 |
| 7,055,226 | B2 | 6/2006 | Uehara et al. | |
| D524,693 | S | 7/2006 | Uehara et al. | |
| 7,096,545 | B2 | 8/2006 | Uehara et al. | |

(Continued)

FOREIGN PATENT DOCUMENTS

| | | | |
|---|---|---|---|
| JP | 07-043568 | U | 9/1995 |
| JP | 2003-033209 | A | 2/2003 |

(Continued)

OTHER PUBLICATIONS

Office Action, Japanese Patent Application No. 2011-506874, mailed Oct. 30, 2012.

(Continued)

*Primary Examiner* — Jack W. Lavinder
(74) *Attorney, Agent, or Firm* — Kilpatrick Townsend & Stockton LLP

(57) ABSTRACT

A side release buckle includes a plug and a socket into which the plug is inserted for engagement. The plug includes: a base being provided with a belt attachment and a pair of legs; and an engaging portion being formed to each of the legs. The socket includes: a body being provided with a belt attachment and an insertion opening; a housing space being formed in the body and capable of housing the legs inserted from the insertion opening (22); and an engaged portion being formed in the body and engageable with the engaging portion. The body includes an undulation being continuously formed in an insertion direction of the legs on at least one of top and bottom surfaces of the body.

20 Claims, 8 Drawing Sheets

(56) References Cited

U.S. PATENT DOCUMENTS

| | | | | |
|---|---|---|---|---|
| 7,100,252 | B2 * | 9/2006 | Anscher | 24/615 |
| 7,111,368 | B2 | 9/2006 | Matoba | |
| 7,318,259 | B2 | 1/2008 | Uehara | |
| 7,320,160 | B2 | 1/2008 | Uehara et al. | |
| D564,408 | S * | 3/2008 | Hsiao | D11/216 |
| 7,346,965 | B2 * | 3/2008 | Hsiao | 24/625 |
| D576,519 | S | 9/2008 | Uehara | |
| D593,403 | S * | 6/2009 | Salentine | D8/395 |
| D597,441 | S | 8/2009 | Uehara | |
| 7,650,676 | B2 | 1/2010 | Saitsu | |
| D614,996 | S * | 5/2010 | Huang | D11/216 |
| D619,042 | S * | 7/2010 | Uehara | D11/216 |
| 7,979,966 | B2 | 7/2011 | Yoshie | |
| 8,112,850 | B2 | 2/2012 | Uehara | |
| D668,178 | S * | 10/2012 | Kao | D11/216 |
| 2002/0040514 | A1 | 4/2002 | Uehara et al. | |
| 2003/0014851 | A1 | 1/2003 | Murai et al. | |
| 2004/0055122 | A1 | 3/2004 | Matoba | |
| 2005/0091808 | A1 | 5/2005 | Uehara et al. | |
| 2005/0235469 | A1 * | 10/2005 | Anscher | 24/615 |
| 2005/0235470 | A1 | 10/2005 | Uehara | |
| 2006/0090310 | A1 | 5/2006 | Uehara et al. | |
| 2006/0168783 | A1 * | 8/2006 | Anscher | 24/615 |
| 2007/0186394 | A1 * | 8/2007 | Hsiao | 24/614 |
| 2007/0204441 | A1 | 9/2007 | Saitsu | |
| 2008/0178438 | A1 | 7/2008 | Yoshie et al. | |
| 2009/0007391 | A1 | 1/2009 | Uehara | |
| 2009/0056089 | A1 * | 3/2009 | Yoshie | 24/616 |
| 2010/0306976 | A1 | 12/2010 | Kaneko et al. | |
| 2011/0173783 | A1 | 7/2011 | Kaneko | |
| 2012/0017407 | A1 | 1/2012 | Uehara et al. | |
| 2012/0030913 | A1 | 2/2012 | Uehara et al. | |
| 2012/0198666 | A1 | 8/2012 | Nanbu et al. | |
| 2012/0227222 | A2 | 9/2012 | Uehara et al. | |
| 2012/0255144 | A1 | 10/2012 | Gaudillere et al. | |
| 2012/0260474 | A1 | 10/2012 | Yoshie et al. | |

FOREIGN PATENT DOCUMENTS

| | | | |
|---|---|---|---|
| JP | 2003-125810 | A | 5/2003 |
| JP | 2005-305112 | A | 11/2005 |
| JP | 2006-129952 | A | 5/2006 |
| JP | 2006-204911 | A | 8/2006 |
| JP | 200721224 | A | 2/2007 |
| JP | 1323896 | S | 3/2008 |
| JP | 2008-178570 | A | 8/2008 |
| JP | 2009-011492 | A | 1/2009 |
| JP | 2009-18003 | A | 1/2009 |
| JP | 2009-061050 | A | 3/2009 |

OTHER PUBLICATIONS

Office Action, Japanese Patent Application No. 2011-506969, mailed Oct. 30, 2012.

International Search Report and Written Opinion, PCT International Patent Application No. PCT/JP2009/056634, mailed Jul. 7, 2009.

International Search Report and Written Opinion, PCT International Patent Application No. PCT/JP2009/071668, mailed Apr. 6, 2010.

Office Action, Japanese Patent Application No. 2011-506969, mailed Apr. 2, 2013.

* cited by examiner

SIDE RELEASE BUCKLE

RELATED APPLICATIONS

This application is a continuation of U.S. patent application Ser. No. 13/258,203 filed on Sep. 21, 2011 entitled "Side Release Buckle," which is a national stage application of PCT/JP2009/056634 filed on Mar. 31, 2009, both of which are incorporated herein by reference.

TECHNICAL FIELD

The present invention relates to a side release buckle configured to, for instance, couple belts, the side release buckle including a pair of lock arms on both sides thereof.

BACKGROUND ART

There has been typically used a buckle that detachably engages a plug with a socket in order to couple string members (e.g., belts) in various applications (e.g., clothes, bags, shoes and packages)

Such a buckle requires easy handling for coupling and releasing as well as no accidental release when the buckle is not intended to be released. As a product that satisfies such needs, a side release buckle including a pair of lock arm on both sides thereof has been used.

For instance, a side release buckle disclosed in Patent Literature 1 or 2 includes a plug and a socket, each of which is provided with a belt attachment.

The plug includes a base including the belt attachment and a pair of legs (lock arms) on both sides near the socket. The socket has a hollow cylindrical body, the body including a housing space (cavity) into which the plug is inserted from a plug-facing side of the body. An opening in communication with the housing space is formed on each side of the body of the socket. The plug and the socket can be disengaged by manipulating the legs exposed through the openings with fingers.

In such a side release buckle, the plug and the socket each are integrally formed mainly of a synthetic resin material. Accordingly, while the legs are provided with a predetermined elasticity, the plug, the socket and the belt attachment are provided with a sufficient strength to resist tension of the coupled belts in use.

Further, the hollow socket is reinforced by, for instance, securing a thickness of the body of the socket such that the socket is not excessively deformed (e.g., crush) by press in a top-bottom direction.

Patent Literature 1 JP-A-2006-204911

Patent Literature 2 Japanese Design Registration No. 1323896

DISCLOSURE OF THE INVENTION

Problems to be Solved by the Invention

In the above-described side release buckle of Patent Literature 1, in order to obtain a guiding function in inserting the plug into the socket, a V-shaped guide bar is formed in the plug and V-shaped cutouts are formed on top and bottom surfaces of the socket. The guide bar of the plug is inserted to be guided along edges of the cutouts.

In the side release buckle of Patent Literature 2, in addition to the same guide bar and the cutouts as the above, V-shaped cutouts are also formed in the socket near the belt attachment.

With such cutouts, a material for the top and bottom surfaces of the socket is reduced and a weight of the buckle is effectively reduced.

However, formation of a lot of cutouts in the socket reduces strength against the above-described deformation and, thus, in fact, requires increase in a thickness of the socket, which may not be necessarily effective for weight reduction.

An object of the invention is to provide a side release buckle with a reduced weight and a secured strength.

Means for Solving the Problems

According to an aspect of the invention, a side release buckle includes a plug and a socket into which the plug is inserted for engagement, in which the plug includes: a base being provided with a belt attachment and a pair of legs; and an engaging portion being formed to each of the legs; the socket includes: a body being provided with a belt attachment and an insertion opening; a housing space being formed in the body and capable of housing the legs inserted from the insertion opening; and an engaged portion being formed in the body and engageable with the engaging portion, and the body includes an undulation being continuously formed in an insertion direction of the legs on at least one of top and bottom surfaces of the body, the undulation being provided by a linear concave formed on an outer surface of the body and a linear convex formed on an inner surface of the body along the linear concave.

According to the above aspect of the invention, with the undulation formed on the body, rigidity of the body can be enhanced without changing a thickness thereof. Particularly, the socket of the side release buckle is easily deformed, for instance, crushed by press in the top-bottom direction. However, such a deformation can be effectively suppressed by forming the undulations on the top and bottom surfaces of the body.

Moreover, since the rigidity is attained because of the undulation formed on the body, a thickness of the socket can be thinned, so that costs and a weight of the buckle can be reduced by reduction in usage of synthetic resin materials.

Further, since the undulation(s) is formed in the insertion direction of the legs, the undulation(s) does not interfere with an insertion operation of the legs and has the following guiding function.

The undulation has no projection outward from the body since an outer surface of the body is provided by a linear concave. Since the linear concave and the linear convex are formed on the top surface or the bottom surface of the body in conformity with the inside and outside thereof, the undulation having a substantially predetermined thickness can be formed on the top surface or the bottom surface of the body. Accordingly, a weight of the body is not increased and a possibility that sink marks and the like may generate in synthetic resin formation is reduced.

A cross section of each of the linear concave and the linear convex may be triangular, quadrangular and the like. It is desirable that an outline forms a smooth undulation such as a shape of a so-called corrugated plate.

According to the above aspect of the invention, the undulation is located in the housing space at an intermediate position between portions in which the pair of legs are housed respectively.

With this arrangement, when the pair of legs are inserted into the housing space, the legs enter at both sides of the undulation. Accordingly, without interference between the legs and the undulation, a thickness (a dimension in a top-bottom direction of the buckle) of each of the legs and the undulation can be attained, which is effective for ensuring strength.

According to the above aspect of the invention, the engaging portion is formed at a tip end of each of the legs and has a dimension in a top-bottom direction larger than each of the legs, and the linear convex is provided by opposing linear convexes formed on both top and bottom surfaces of the body with a gap therebetween smaller than a gap between portions in which the linear convex is not formed.

With this arrangement, the engaging portion is formed to project in the top-bottom direction of the buckle from the tip end of each of the legs and is configured to engage with the engaged portion formed on an inside of each of the top and bottom surfaces of the socket. Moreover, since the gap between the linear convexes is formed smaller than one between portions surrounding the linear convexes of the body, when the plug is inserted, each of the linear convex is interposed between the engaging portions of the tip ends of the legs, thereby providing a guiding function.

According to the above aspect of the invention, the undulation also functions as a guide to guide the engaging portion to the engaged portion when the legs are inserted.

With this arrangement, when the pair of legs are inserted into the housing space, the undulation can function as a guide for the legs, particularly, as a guide to guide the engaging portion to the engaged portion by adjusting a shape of the undulation, thereby facilitating and ensuring an engagement operation of the buckle.

According to the above aspect of the invention, a cutout extending along the undulation from an edge of at least one of the insertion opening and the belt attachment is formed in the top and bottom surfaces of the body.

With this arrangement, since the rigidity is attained because of the undulation formed on the body, a thickness of the socket can be thinned as described above. Additionally, since the cutout is formed, a material for the socket is further reduced. Consequently, production costs and the weight of the socket can be further reduced.

According to the above aspect of the invention, the cutout has a C-shaped or U-shaped outline.

Since the cutout is formed to have a C-shaped or U-shaped outline, the outline of the cutout has no steeply angled discontinuous portion, so that stress concentration and difficulties in formation can be avoided.

According to the above aspect of the invention, the cutout includes a U-shaped deep cutout extending from the belt attachment and a C-shaped shallow cutout extending from the insertion opening.

With this arrangement, since the cutouts are provided near the belt attachment and near the insertion opening, the material for the body is minimized, so that production costs and the weight thereof can be reduced at the maximum. Since the cutout near the belt attachment is formed deep and the cutout near the insertion opening is formed shallow, a remaining portion between the cutouts (a portion connecting left and right sides of the body) is spaced from the belt attachment (which also connects the left and right sides of the body). Accordingly, while torsional rigidity of the body can be attained, the guiding function for the legs by the undulation formed on the remaining portion can work at an early stage of the insertion operation.

According to the above aspect of the invention, the cutout includes the cutout extending along the belt attachment, the cutout being formed with a projection projecting along the belt attachment as portions facing both ends of the belt attachment.

With this arrangement, even when the opening facing the belt attachment is enlarged by the cutout, the projection has a function to hold down both ends of the belt, so that the belt put into the belt attachment is prevented from improperly being lifted up or dropping off from the belt attachment.

According to the above aspect of the invention, the plug includes a connecting portion configured to connect the pair of legs, an inner shape of the legs and the connecting portion is a C-shape or U-shape, and the cutout includes the cutout extending along the belt attachment, an outline of the cutout being formed along the inner shape of the legs and the connecting portion.

With this arrangement, even when the cutout extending from the belt attachment is formed, neither the legs nor the connecting portion is exposed out of the cutout, so that, for instance, the legs or the connection portion is prevented from being caught by other articles and appearance is not impaired.

BEST MODE FOR CARRYING OUT THE INVENTION

Exemplary embodiments of the invention will be described below with reference to the attached drawings.

First Exemplary Embodiment

FIGS. 1 to 7 show a first exemplary embodiment of the invention.

Figure 1:
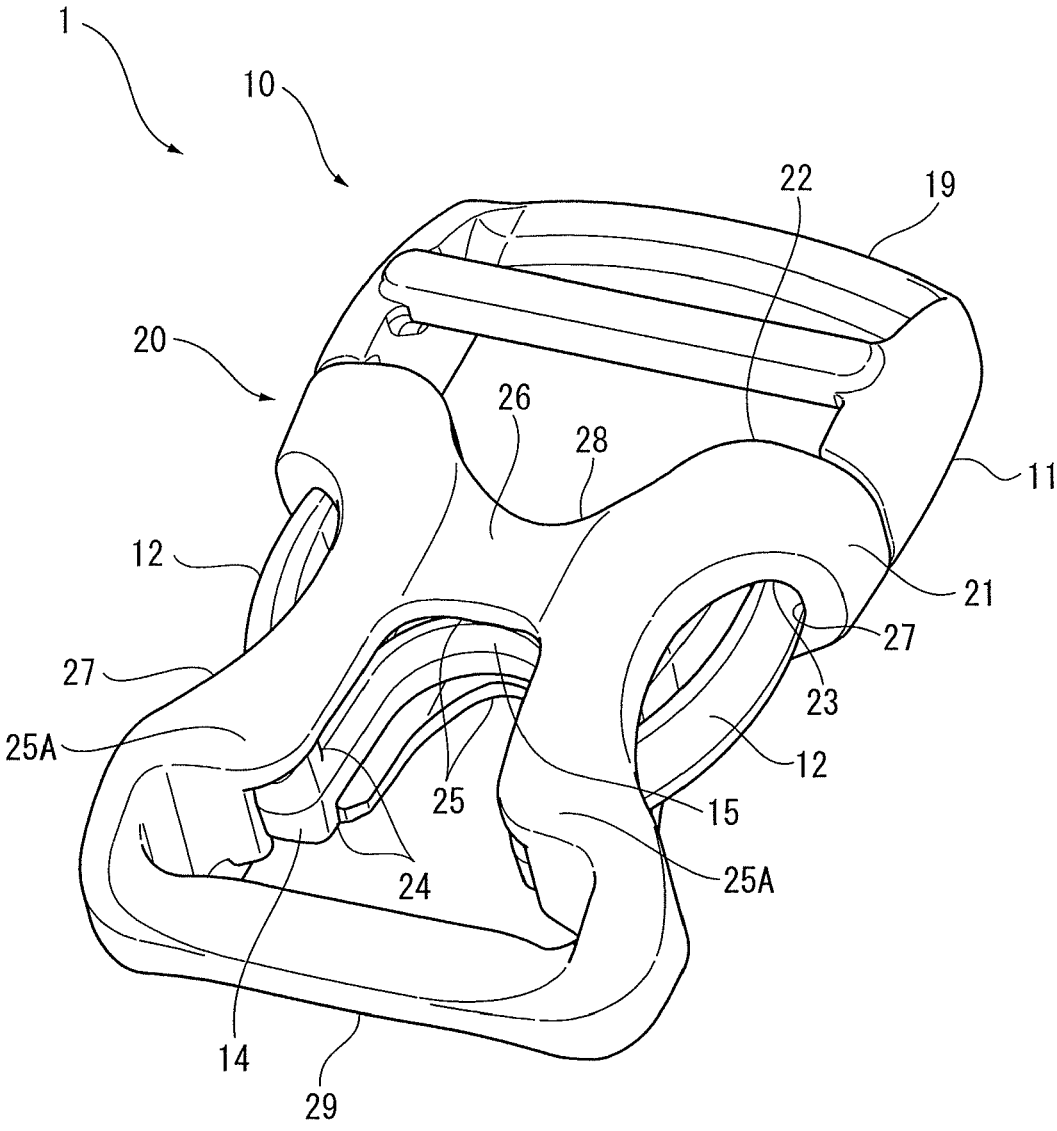
FIG. 1 is a perspective view showing a top surface of a side release buckle according to a first exemplary embodiment of the invention.
Figure 2:
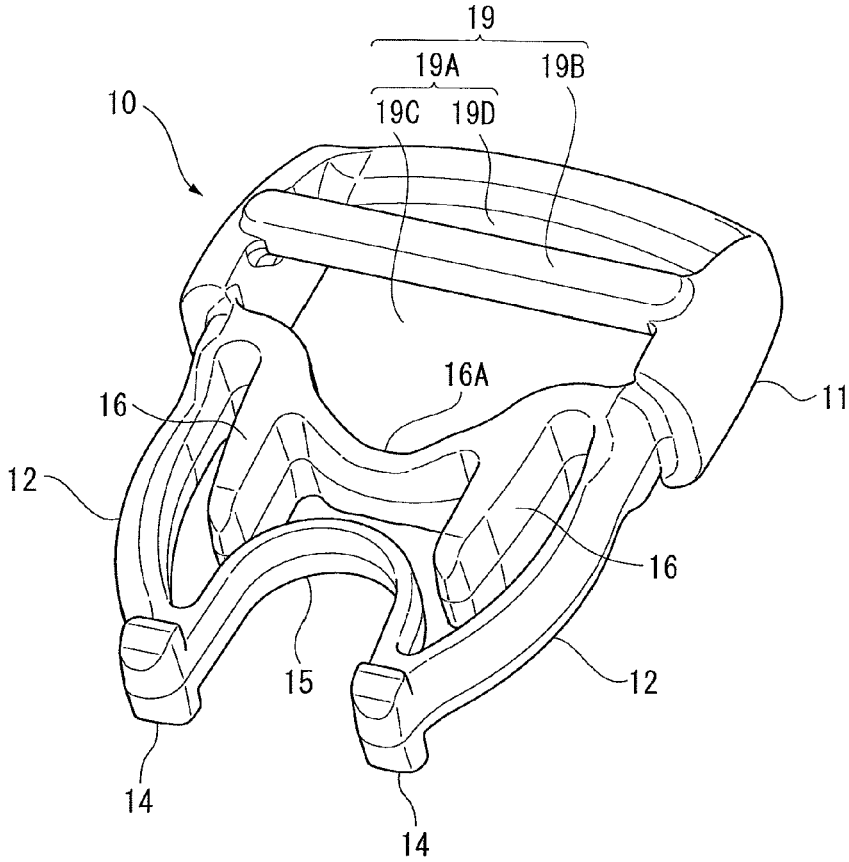
FIG. 2 is a perspective view showing a top surface of a plug according to the first exemplary embodiment.
Figure 3:
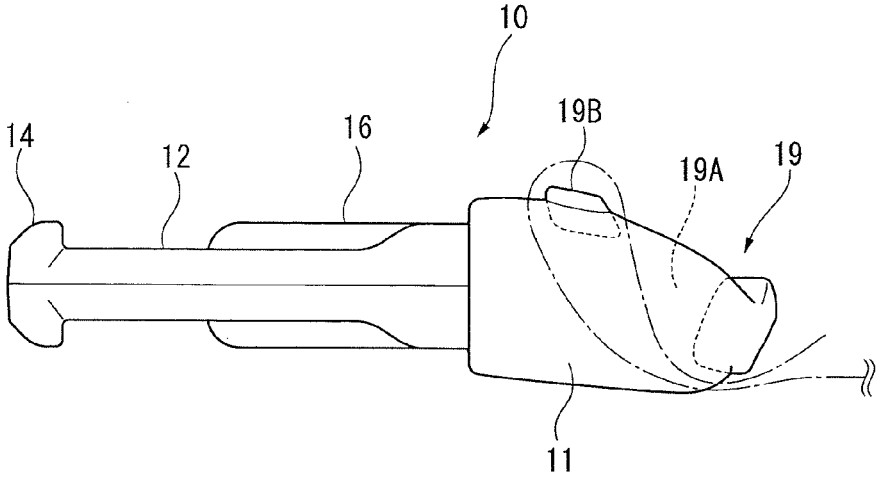
FIG. 3 is a lateral side view showing the plug according to the first exemplary embodiment.

As shown in FIGS. 1 to 3, a side release buckle 1 according to this exemplary embodiment includes a plug 10 and a socket 20 into which the plug 10 is inserted for engagement.

As shown in the figures, the side release buckle 1 according to the first exemplary embodiment is used to couple and release ends of a string member. The buckle 1 includes the plug 10 integrally formed of a synthetic resin and the socket 20 also integrally formed of a synthetic resin. The plug 10 and the socket 20 may be formed of other materials such as metal in addition to the synthetic resin by other forming methods in addition to an injection forming.

In FIGS. 1 and 2, the entirety of the plug 10 is integrally formed of the synthetic resin by an injection forming. The plug 10 includes a base 11 having a belt attachment 19 and a pair of legs 12, and an engaging portion 14 provided to each of the legs 12.

The legs 12 extend in a lengthwise direction (an insertion direction of the plug 10 to the socket 20, i.e., a vertical direction in FIG. 1) from both sides of the base 11 in a widthwise direction (a direction orthogonal to the insertion direction of the plug 10 to the socket 20 and a top-bottom direction of the socket 20, i.e., a horizontal direction in FIG. 1). The legs 12 are parallel to each other. A portion from the center to the tip end of each of the legs 12 is elastically deformable in a direction separating from each other or in a direction approaching each other (the above-described widthwise direction).

The pair of legs 12 are gradually inclined in the direction approaching each other toward the tip ends of the legs 12 in the insertion direction and are curved with a predetermined clearance. Accordingly, the legs 12 can entirely receive elastic deformation force.

The engaging portion 14 is formed as a projection extending upward and downward (the top-bottom direction of the socket 20) from the tip end of each of the legs 12. The tip end of each of the legs 12 is T-shaped in a lateral side view. In other words, the engaging portion 14 is formed at the tip end of each of the legs 12 and a dimension in the top-bottom direction (a height) of the engaging portion 14 is formed larger than a height of each of the legs 12.

The belt attachment 19 is formed in a middle part of the base 11.

As shown in FIG. 2, the belt attachment 19 includes a string attachment hole 19A (a string attachment portion) into which an end of the string member is inserted to be locked at an internal center thereof, and a connecting bar 19B formed across the string attachment portion in a middle of the string attachment portion. The string attachment hole 19A is divided by the connecting bar 19B into a front hole 19C and a rear hole 19D in the insertion direction. With this arrangement, a length of the string member can be adjusted by winding the string member around the connecting bar 19B after inserting the string member through the string attachment hole 19A.

In FIG. 2, tip ends of the pair of legs 12 are connected by a U-shaped connecting portion 15.

The connecting portion 15 has portions that extend from the engaging portions 14 of the tip ends of the legs 12 toward the belt attachment 19 and approach each other to be connected, so that the connecting portion 15 is formed in a U-shape. The connecting portion 15 prevents the pair of legs 12 from being excessively expanded by external force.

A pair of guided portions 16 are provided between the pair of legs 12.

As shown in FIG. 3, each of the guided portions 16 has the same height as that of the engaging portion 14 of the tip end of each of the legs 12. An upper edge of each of the guided portions 16 projects upward beyond an upper edge of each of the legs 12 while a lower edge of each of the guided portions 16 projects downward beyond a lower edge of each of the legs 12. The engaging portions 14 and the guided portions 16 are guided by an undulation (described later) formed inside the socket 20, whereby the plug 10 is led to an appropriate position in an insertion operation.

As shown in FIG. 2, the guided portions 16 are connected to each other via a connecting frame 16A near the base 11. The connecting frame 16A connects opposing portions of the guided portions 16 near the base 11. A middle portion of the connecting frame 16A is curved in a manner to project in the insertion direction of the plug 10. The middle portion of the connecting frame 16A is formed to have a height in a top-bottom direction lower than a height of each of the guided portions 16. The height is increased at a position closer to ends of the connecting frame 16A and reaches the height of each of the guided portions 16 at the ends of the connecting frame 16A. Thus, top and bottom surfaces of the connecting frame 16A are gradually dented at respective centers thereof. This profile corresponds to an outline of the linear convex 26B formed on an inner surface of a body 21 (described later).

Figure 4:
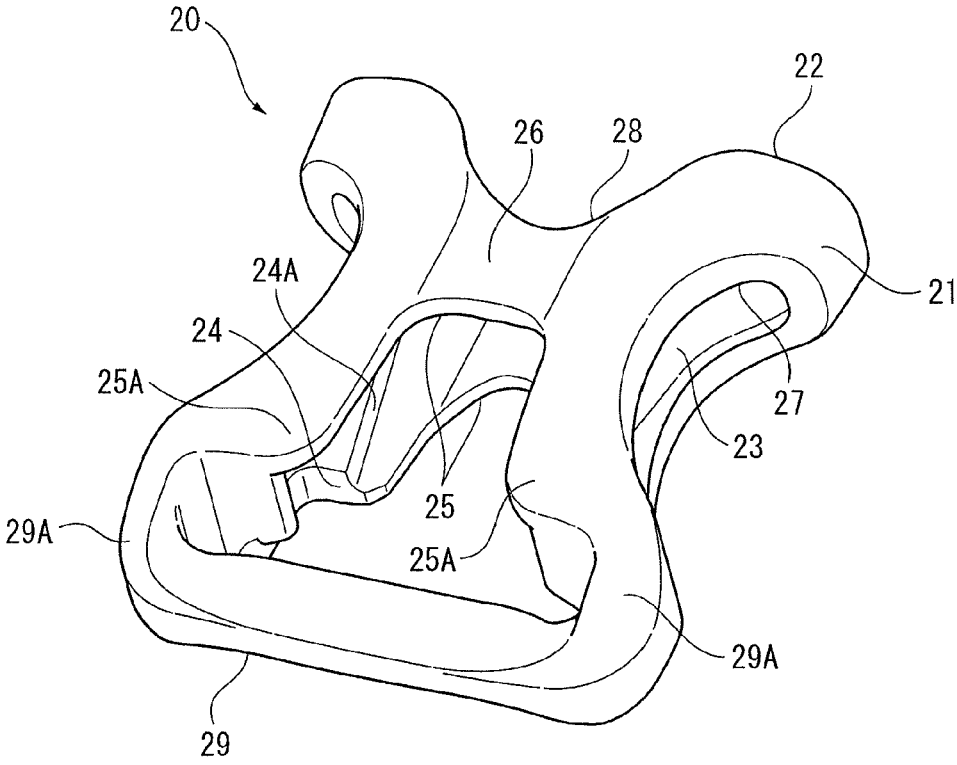
FIG. 4 is a perspective view showing a top surface of a socket according to the first exemplary embodiment.

In FIGS. 1 and 4, an entirety of the socket 20 is integrally formed of a synthetic resin by an injection forming. The socket 20 includes: the hollow cylindrical body 21 including a belt attachment 29 and an insertion opening 22; a housing space 23 being formed in the body 21 and capable of housing the legs 12 of the plug 10 inserted from the insertion opening 22; and an engaged portion 24 being formed in the body 21 and engageable with the engaging portion 14.

As shown in FIG. 4, the engaged portions 24 are formed from steps that are formed at four positions inside the housing space 23 and face the belt attachment 29 (in a direction opposite to the insertion opening 22). Two of the four steps (the engaged portions 24) are formed on an inner side of the bottom surface of the body 21 and face the housing space 23 and lateral portions 29A of the belt attachment 29 of the body 21. The other two of the four steps, which are formed on an inner side of the top surface of the body 21 in the same manner as the above, are covered by projections 25A on the top surface of the body 21. Among the four steps, an opposing pair of steps respectively on the top and bottom surfaces provide the engaged portions 24. In the socket 20 according to this exemplary embodiment, a pair of engaged portions 24 aligned in a width direction are provided to correspond to the engaging portions 14 formed to the pair of legs 12.

A leading surface 24A is formed in the housing space 23 for leading the engaging portion 14 to the engaged portion 24 for engagement.

The leading surface 24A is a step continuously formed from a vicinity of each lateral end of the insertion opening 22 to the engaged portion 24 along an inner side of each of the top and bottom surfaces of the body 21. When the legs 12 are inserted from the insertion opening 22, the leading surfaces 24A function as a guide configured to lead the engaging portions 14 at the tip ends of the legs 12 to the engaged portions 24. In other words, the engaging portions 14, which are located at the tip ends of the legs 12 inserted from the insertion opening 22, are led along the leading surfaces 24 and approach each other when the pair of legs 12 are elastically deformed. When the engaging portions 14 reach the engaged portions 24, the legs 12 elastically deformed by the leading surfaces 24A are recovered, so that the engaging portions 14 fit in the engaged portions 24 for mutual engagement.

On the other hand, in order to disengage the engaging portions 14 from the engaged portions 24, a manipulation opening 27 is formed on the body 21. The manipulation opening 27 is formed on each of lateral sides of the body 21 and communicates with the housing space 23 inside the body 21. The manipulation opening 27 is positioned to expose a middle portion of each of the legs 12 inserted from the insertion opening 22. By pressing inward the legs 12 exposed out of the manipulation openings 27, the pair of legs 12 are elastically deformed to approach each other, whereby the engaging portions 14 are disengaged from the engaged portions 24 for mutual disengagement.

The body 21 includes an undulation 26 continuously formed in an insertion direction of the legs 12 substantially on a center of each of the top and bottom surfaces of the body 21.

Figure 5:
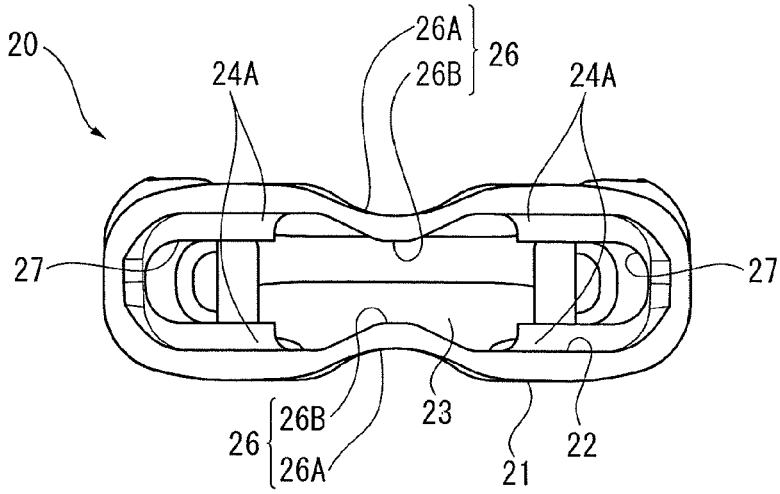
FIG. 5 is a front view showing an insertion opening of the socket according to the first exemplary embodiment.

As shown in FIG. 5, the undulation 26 is provided by a linear concave 26A formed on an outer surface of the body 21 and a linear convex 26B formed on an inner surface of the body 21 along the linear concave 26A. A thickness of a portion sandwiched by the linear concave 26A and the linear convex 26B is the same as those of other portions of the body 21. In other words, the undulation 26 is cross-sectionally a corrugated plate provided by curving a part of a flat plate.

The undulation 26 is formed on each of the top and bottom surfaces of the body 21, whereby the body 21 is formed like a corrugated plate curved in a direction in which the centers of the opposing top and bottom surfaces approach. With this arrangement, strength is secured substantially at the centers where press force working in the top-bottom direction is most likely to be applied and cracks are likely to generate, and thus crush and cracks are effectively prevented.

The undulations 26 are positioned on the top and bottom surfaces of the body 21 to correspond to each other. The linear convexes 26B of the undulations 26 are positioned to fit in respective dents on the top bottom surfaces of the connecting frame 16A between the legs 12 inserted into the housing space 23. A gap between the linear convexes 26B is set smaller than the height of each of the engaging portions 14 and the height of each of the guided portions 16 (the dimension in the top-bottom direction). When the legs 12 are inserted, the engaging portions 14 and the guided portions 16 are guided along the undulation 26. The undulation 26 provides a guiding function to suitably guide the engaging portions 14 to the engaged portions 24 while adjusting a posture of the plug 10. At this time, owing to the dents on the top and bottom surfaces, the connecting frame 16A between the guided portions 16 can be inserted into the gap of the linear convexes 26B without interference with the linear convexes 26B.

A height of the housing space 23 into which each of the guided portions 16 is introduced is formed to fit with the height of each of the guided portion 16. While the guided portions 16 remain inserted in the housing space 23, when the socket 20 is pressed in the top-bottom direction, the guided portions 16 support the socket 20 and prevent excessive deformation such as crush in the top-bottom direction.

Figure 6:
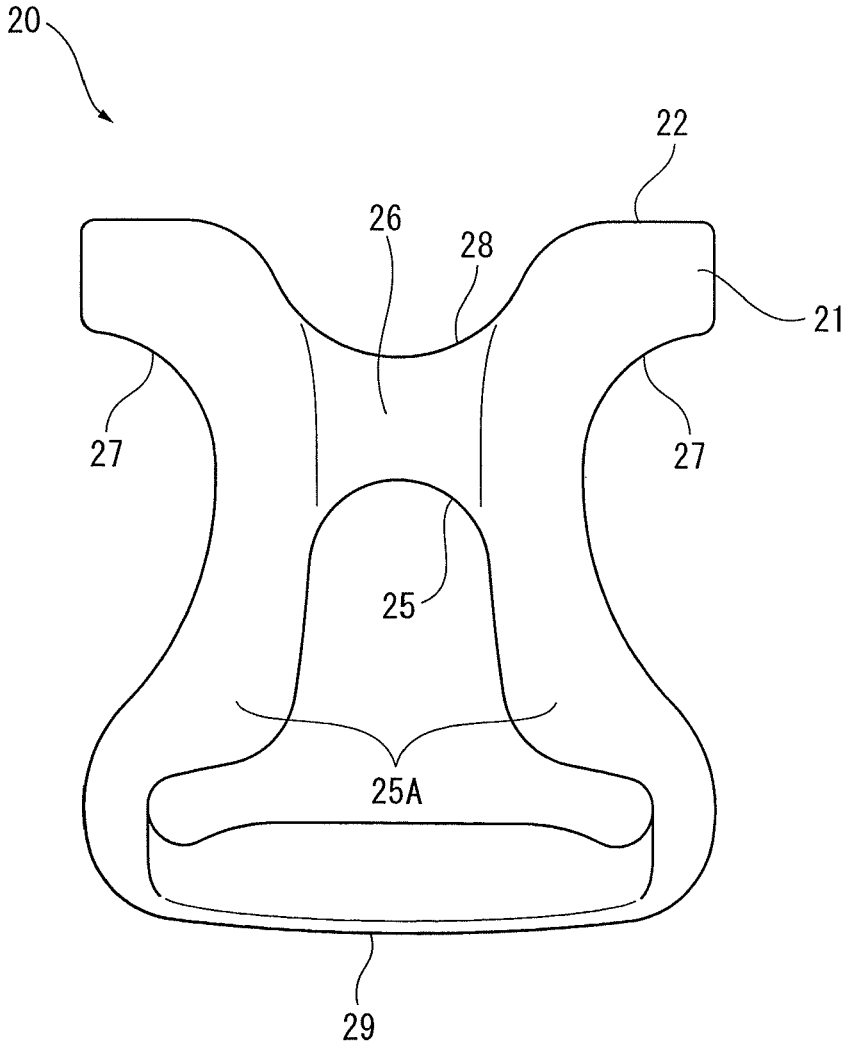
FIG. 6 is a plan view showing the top surface of the socket according to the first exemplary embodiment.
Figure 7:
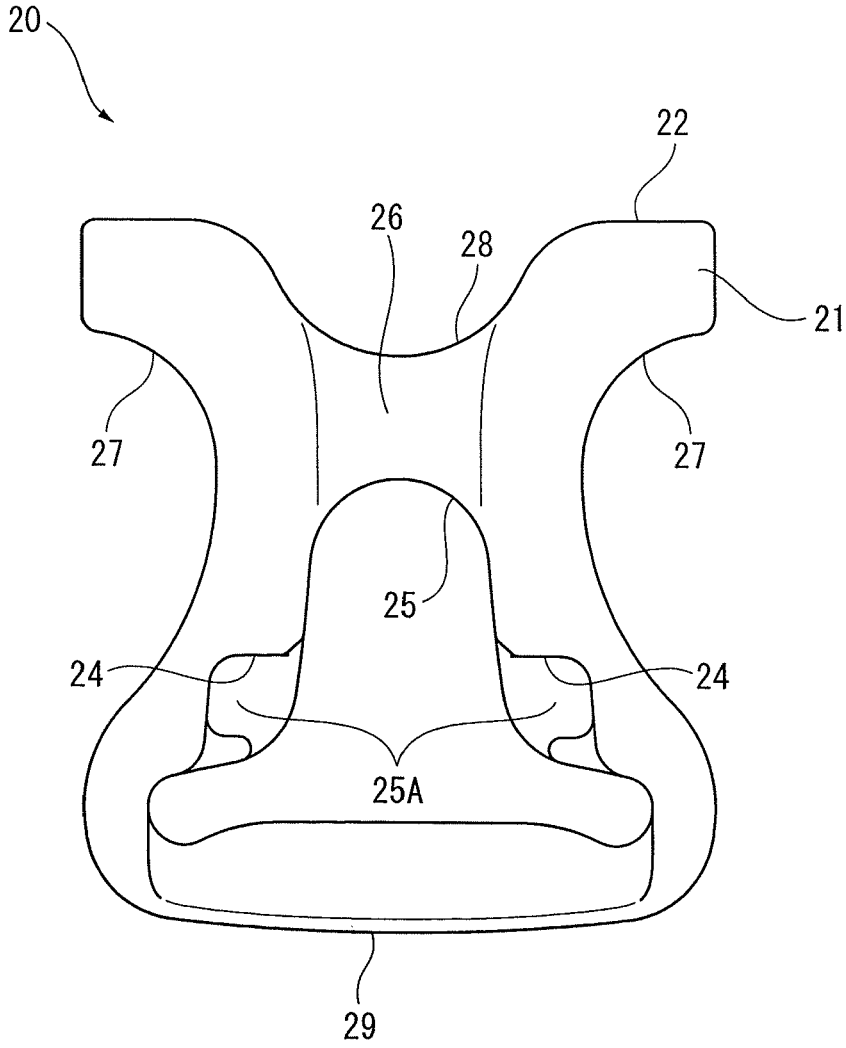
FIG. 7 is a plan view showing a bottom surface of the socket according to the first exemplary embodiment.

As shown in FIGS. 6 and 7, a cutout 28 and a cutout 25 are provided on each of the top and bottom surfaces of the body 21. The cutout 28 extending along the undulation 26 is formed such that the center of a widthwise edge of the insertion opening 22 is dented toward the belt attachment 29 to form an arc. The cutout 25 extending along the undulation 26 is formed such that the center of a widthwise edge of a belt-insertion opening near the belt attachment 29 is dented toward the insertion opening 22 to form an arc.

The cutout 25 is a U-shaped deep cutout extending from the belt attachment 29. The cutout 28 is a C-shaped shallow cutout extending from the insertion opening 22. The most inward parts of the cutouts 25 and 28 are shaped in an arc.

A C-shaped edge of the cutout 28 forms an outline along an inner shape of the connecting frame 16A formed to the base 11 of the plug 10. With this outline, while the cutout 28 is maximally enlarged, the base 11 is not exposed more than necessary.

A U-shaped edge of the cutout 25 forms an outline along an outer shape of the legs 12 and the connecting portion 15. As described above, the tip ends of a pair of legs 12 are connected to each other by the connecting portion 15 to form a U-shaped inner shape in an entirety. The outline of the cutout 25 is formed in line with this shape. With this outline, while the cutout 25 is maximally enlarged, the legs 12 and the connecting portion 15 are not exposed.

In the cutout 25 formed on the top surface of the body 21 among the cutouts 25, portions facing both edges of the belt attachment 29 are provided as projections 25A projecting along the belt attachment 29. The above-described engaged portions 24 near the top surface are covered by the projections 25A. The projections 25A prevent the belt inserted in the belt attachment 29 from being improperly lifted up.

The cutout 25 formed on the bottom surface of the body 21 includes no portion corresponding to the projections 25A. A part of an edge of the cutout 25 is formed along the step of each of the engaged portions 24, so that the engaged portions 24 are exposed from the bottom surface of the body 21.

As shown in FIG. 4, a height of the lateral portions 29A of the belt attachment 29 of the body 21 is larger than that of a belt-winding portion of the belt attachment 29, whereby a sufficient connection strength is attained.

In this exemplary embodiment, the following advantages will be obtained.

With the undulation 26 formed on the body 21 of the socket 20, rigidity of the body 21 can be enhanced without changing a thickness thereof. Particularly, against such a possible deformation of the socket 20 of the side release buckle 1 caused by being crushed by press in the top-bottom direction, the undulation 26 generates bending rigidity based on the cross section thereof, thereby effectively suppressing deformation of the body 21. Particularly, because the undulations 26 are present substantially at the center which is easily cracked by force in a crushing direction, the socket 20 is prevented from cracking and becomes unlikely to be broken.

Moreover, since the undulations 26 reliably provide rigidity, a thickness of the socket 20 can be thinned, so that costs can be reduced by reduction in usage of synthetic resin materials and a weight of the buckle can be reduced.

Further, since the undulations 26 are formed in the insertion direction of the legs 12, the undulations 26 are configured to have no interference with an insertion operation of the legs 12 and also to have a guiding function for the engaging portions 14 of the legs 12 and the guided portions 16.

Each of the undulations 26 includes the linear concave 26A and the linear convex 26B, the linear concave 26A being formed on the outer surface of the body 21, the linear convex 26B being formed on the inner surface thereof. In other words, the undulations 26 are provided by forming the top and bottom surfaces of the body 21 in a corrugated plate. Accordingly, each of the undulations 26 has a substantially constant thickness on the top or bottom surface of the body to avoid an increase in weight and to reduce a possible generation of sink marks and the like in synthetic resin formation.

In addition, since the linear concave 26A is defined as the outer surface of the body 21, the body 21 has no outward projection, which gives a simple appearance of the body 21.

The undulations 26 are provided in a projecting manner between portions of the housing space 23 in which the legs 12 are housed. Accordingly, when the pair of legs 12 are inserted into the housing space 23, the legs 12 enter both the sides of the undulations 26 without mutual interference. Consequently, a thickness (a dimension in the top-bottom direction of the buckle) of each of the legs 12 and the undulations 26 can be increased, which is effective in securing strength.

Moreover, the undulations 26 also serve as a guide to guide the engaging portions 14 to the engaged portions 24 when the legs 12 are inserted therein, which allows the plug 10 and the socket 20 to be easily and reliably engaged with each other.

Since the cutouts 25 and 28 are formed on the top and bottom surfaces of the body 21, the cutouts 25 and 28 respectively extending from the edges of the belt attachment 29 and the insertion opening 22 along the undulations 26, the material for the socket 20 can be further reduced, whereby reduction in production costs and the weight is further promoted.

Since the cutouts 25 and 28 are respectively formed to have the outlines in a deep U-shape and a shallow C-shape, the outlines of the cutouts 25 and 28 have no steeply-angled discontinuous portions, so that stress concentration and disadvantages on formation can be avoided. Particularly, since the outlines of the cutouts 25 and 28 respectively fit with the legs 12 and the connecting portion 15 housed in the housing space 23 or the opening of the belt attachment 19, each of the cutouts can have the maximum area while the legs 12 and the connecting portion 15 are reliably covered.

The cutout 25 is provided as a deep cutout extending from the belt attachment 29 and the cutout 28 is provided as a shallow cutout extending from the insertion opening 22. Such provision of the cutouts near the belt attachment 29 and the insertion opening 22 can minimize the material for the body 21, thereby maximally reducing the production costs and the weight thereof.

Since the cutout 25 near the belt attachment 29 is formed deep and the cutout 28 near the insertion opening 22 is formed shallow, a remaining portion between the cutouts (a portion connecting left and right sides of the body 21) is positioned remote from the belt attachment 29 (similarly, connecting left and right sides of the body 21). Accordingly, while torsional rigidity of the body 21 can be attained, the guiding function for the legs 12 by the undulation 26 formed on the remaining portion can work at an earlier stage of the insertion operation.

The cutout 25 is provided with the projections 25A projecting along the belt attachment 29 at the portions facing both the edges of the belt attachment 29. Accordingly, the projections 25A can prevent the belt put into the belt attachment 29 from improperly being lifted up or dropping off from the belt attachment 29 even when the opening facing the belt attachment 29 is enlarged by providing the cutout 25.

Since the outline of the cutout 25 is formed along in the inner shape of the legs 12 and the connecting portion 15, neither the legs 12 nor the connecting portion 15 comes out of the cutout, so that, for instance, the legs or the connecting portion is prevented from being caught by other articles and appearance is not impaired.

Second Exemplary Embodiment

Figure 8:
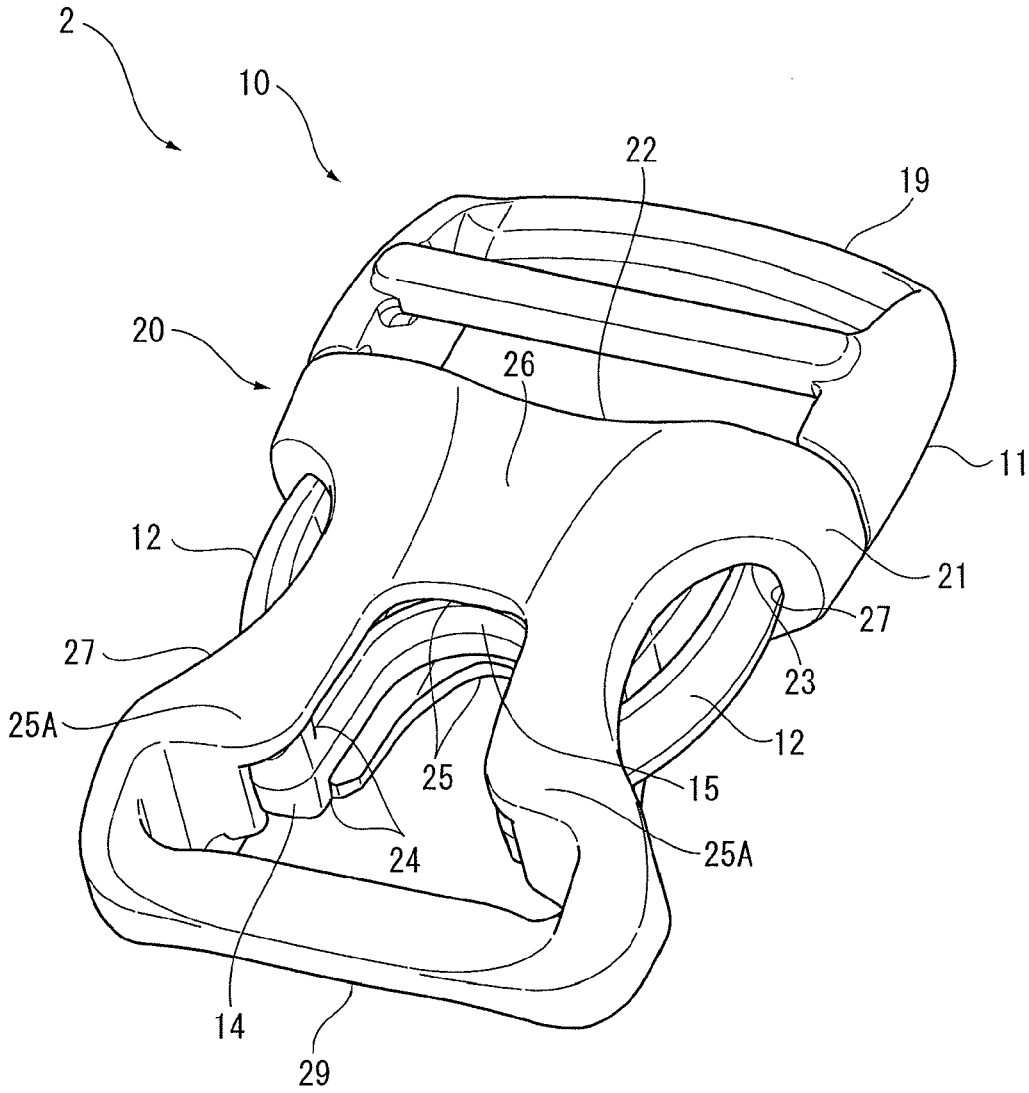
FIG. 8 is a perspective view showing a top surface of a side release buckle according to a second exemplary embodiment of the invention.

FIG. 8 shows a second exemplary embodiment of the invention.

A side release buckle 2 according to this exemplary embodiment includes the same plug 10 and socket 20 as those in the first exemplary embodiment. According to this exemplary embodiment, although the cutout 25 is formed on the socket 20 near the belt attachment 29, the cutout 28 as shown in the first exemplary embodiment (see FIG. 1) is not formed. The undulation 26, which is longer than that in the first exemplary embodiment by a length of the cutout 28, is continuously formed from the edge of the insertion opening 22.

Since the cutout 28 in FIG. 1 is not provided, this exemplary embodiment is not effective in reducing the material and the weight of the body 21. However, except for this, the same advantages as those in the first exemplary embodiment can be obtained. Further, the longer undulation 26 according to this exemplary embodiment can enhance the rigidity of body 21 more than the undulation 26 according to the first exemplary embodiment.

Third Exemplary Embodiment

Figure 9:
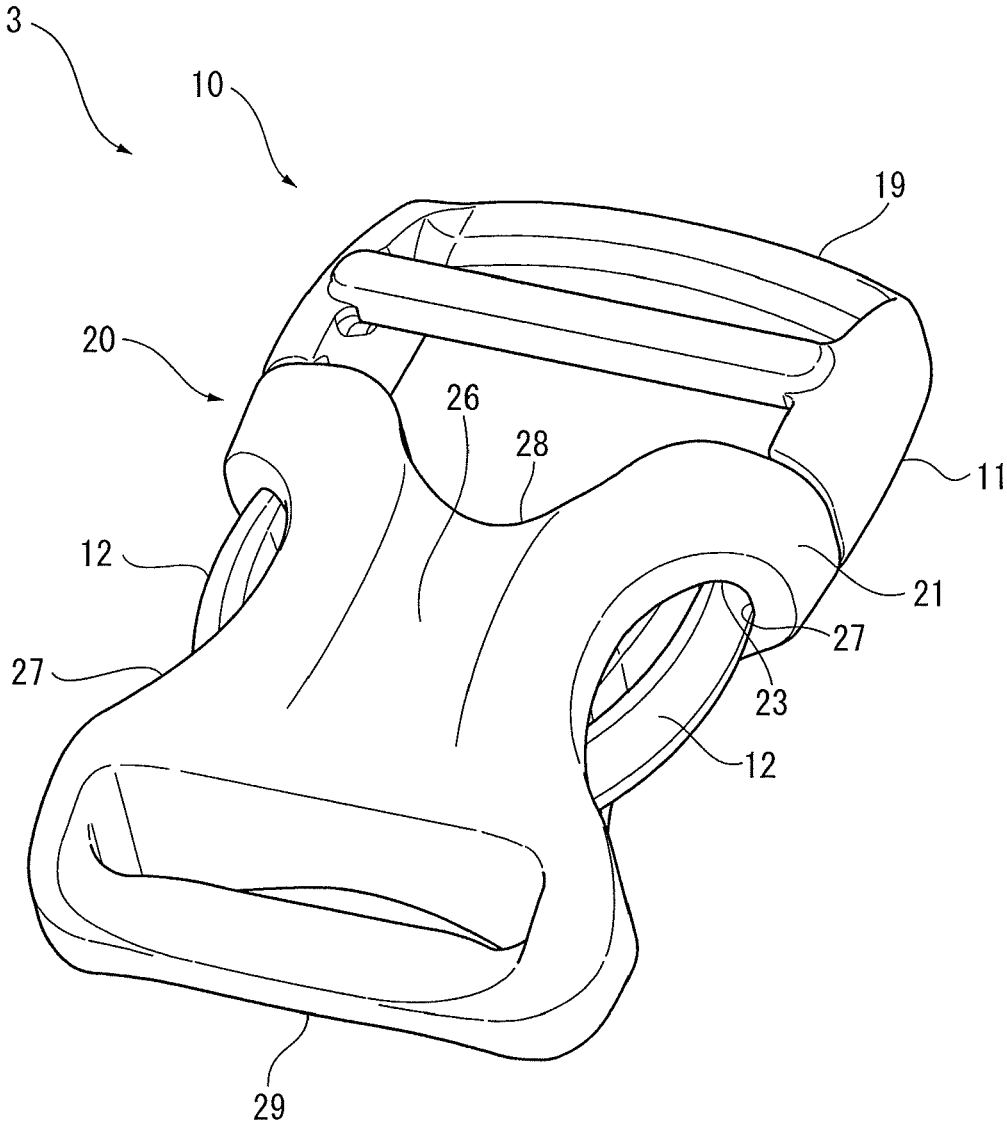
FIG. 9 is a perspective view showing a top surface of a side release buckle according to a third exemplary embodiment of the invention.

FIG. 9 shows a third exemplary embodiment of the invention.

A side release buckle 3 according to this exemplary embodiment includes the same plug 10 and socket 20 as those in the first exemplary embodiment. According to this exemplary embodiment, although the cutout 28 is formed on the socket 20 near the insertion opening 22, the cutout 25 as shown in the first exemplary embodiment (see FIG. 1) is not formed. The undulation 26, which is longer than that in the first exemplary embodiment by a length of the cutout 25, is continuously formed from the edge of the belt attachment 29.

Since the cutout 25 in FIG. 1 is not provided, this exemplary embodiment is not effective in reducing the material and the weight of the body 21. However, except for this, the same advantages as those in the first exemplary embodiment can be obtained. Further, the longer undulation 26 according to this exemplary embodiment can enhance the rigidity of body 21 more than the undulation 26 according to the first exemplary embodiment.

Fourth Exemplary Embodiment

Figure 10:
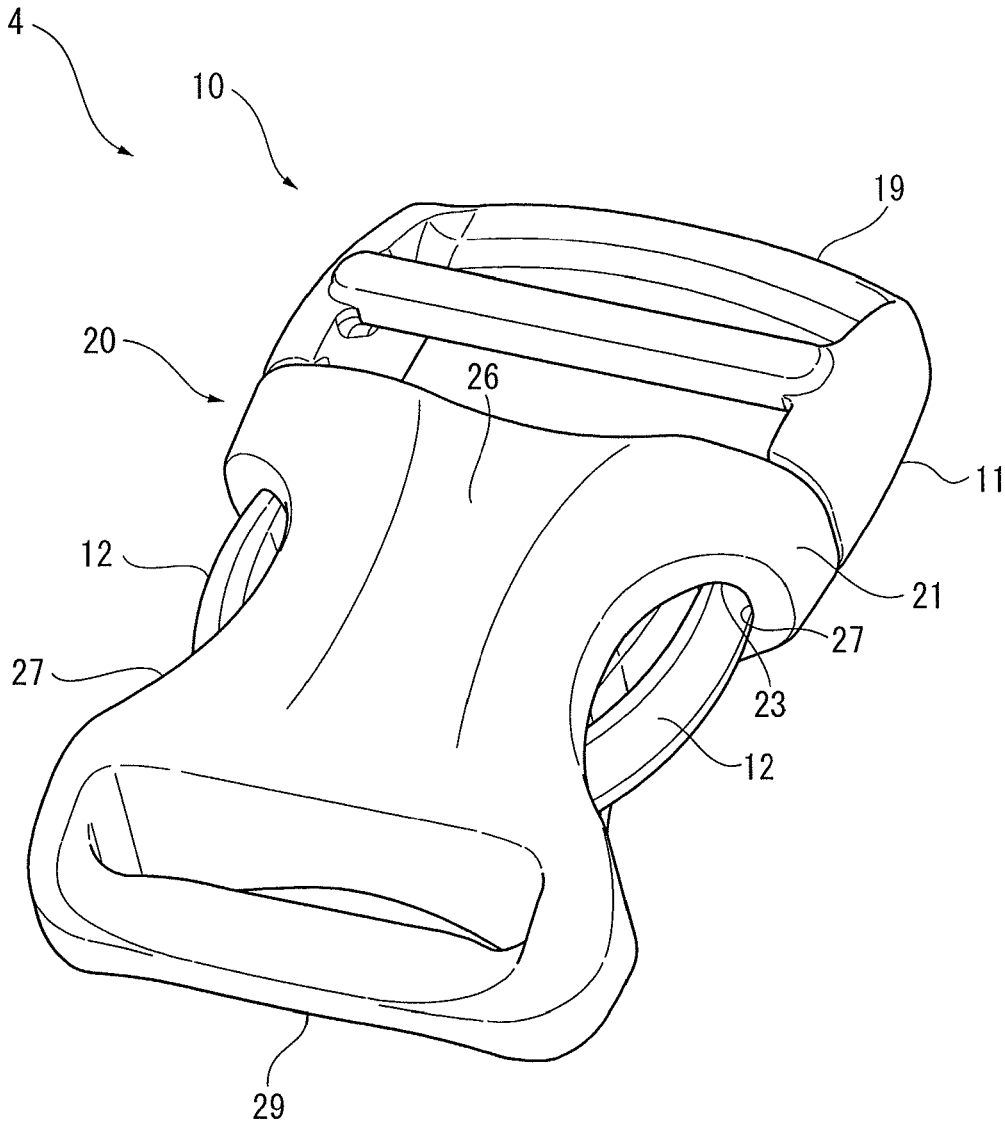
FIG. 10 is a perspective view showing a top surface of a side release buckle according to a fourth exemplary embodiment of the invention.

FIG. 10 shows a fourth exemplary embodiment of the invention.

A side release buckle 4 according to this exemplary embodiment includes the same plug 10 and the socket 20 as those in the first exemplary embodiment. According to this exemplary embodiment, neither the cutouts 25 nor 28 as shown in the first exemplary embodiment (see FIG. 1) is formed on the socket 20 and the longer undulation 26 is continuously formed from the edge of the insertion opening 22 to the belt attachment 29.

Since the cutouts 25 and 28 in FIG. 1 are not provided, this exemplary embodiment is not effective in reducing the material and the weight of the body 21. However, except for this, the same advantages as those in the first exemplary embodiment can be obtained. Further, the longer undulation 26 according to this exemplary embodiment can enhance the rigidity of body 21 more than the undulation 26 according to the first exemplary embodiment.

Modifications

It should be noted that the invention is not limited to the above arrangements of the exemplary embodiments but encompasses the following modifications.

The cross section of each of the linear concave 26A and the linear convex 26B is not limited to a shape of a corrugated plate, but may be triangular, quadrangular and the like. It is desirable that an outline forms a smooth undulation such as a shape of a so-called corrugated plate.

An arrangement of the undulation 26 is not limited to the arrangement by the corresponding positions and shapes defined by the linear concave 26A and the linear convex 26B. The undulation 26 may be formed only by a single linear convex 26B or a plurality of linear convexes 26B formed on the outer or inner surface of the body 21. The undulation 26 can obtain a guiding function of the legs 12 when formed on the inner surface of the body 21 (in the housing space 23). When the linear concave 26A and the linear convex 26B are formed in a manner to correspond to each other, the body 21 can have a constant thickness, which is desirable in synthetic resin formation.

The undulation(s) 26 is not necessarily formed on both the top and bottom surfaces of the body 21, but may be provided on either the top surface or the bottom surface.

A shape of each of the cutouts 25 and 28 is not limited to a U-shape or a C-shape, but may be a V-shape or rectangular. However, when the innermost parts of the cutouts 25 and 28 are shaped in an arc such as a U-shape or a C-shape, unnecessary stress concentration can be avoided and such a shape is suitable for attaining the strength.

In addition, detailed shapes and structures of the plug 10 and the socket 20 can be changed as needed. A dimension, material, color, surface finish of each of the plug 10 and the socket 20 can be selected as needed in implementation of the invention.

The invention claimed is:

1. A side release buckle comprising: a plug; and a socket into which the plug is inserted for engagement, wherein the plug comprises: a base being provided with a belt attachment and a pair of legs; and an engaging portion being formed to each of the legs, the socket comprises: a body being provided with a belt attachment and an insertion opening; a housing space being formed in the body and capable of housing the legs inserted from the insertion opening; and an engaged portion being formed in the body and engageable with the engaging portion, and the body comprises an undulation being continuously formed in an insertion direction of the legs on at least one of top and bottom surfaces of the body, the undulation being provided by a linear concave formed on an outer surface of the body and a linear convex formed on an inner surface of the body along the linear concave.

2. The side release buckle according to claim 1, wherein the undulation is located in the housing space at an intermediate position between portions in which the pair of legs are housed respectively.

3. The side release buckle according to claim 2, wherein the engaging portion is formed at a tip end of each of the legs and has a dimension in a top-bottom direction larger than each of the legs, and the linear convex is provided by opposing linear convexes formed on both top and bottom surfaces of the body with a gap therebetween, the opposing linear convexes smaller than a gap between portions in which the linear convex is not formed.

4. The side release buckle according to claim 2, wherein the undulation also functions as a guide to guide the engaging portion to the engaged portion when the legs are inserted.

5. The side release buckle according to claim 1, wherein a cutout extending along the undulation from an edge of at least one of the insertion opening and the belt attachment is formed in the top and bottom surfaces of the body.

6. The side release buckle according to claim 5, wherein the cutout has a C-shaped or U-shaped outline.

7. The side release buckle according to claim 5, wherein the cutout comprises a U-shaped deep cutout extending from the belt attachment and a C-shaped shallow cutout extending from the insertion opening.

8. The side release buckle according to claim 5, wherein the cutout comprises the cutout extending along the belt attachment, the cutout being formed with a projection projecting along the belt attachment as portions facing both ends of the belt attachment.

9. The side release buckle according to claim 5, wherein the plug comprises a connecting portion configured to connect the pair of legs, an inner shape of the legs and the connecting portion is a C-shape or U-shape, and the cutout comprises the cutout extending along the belt attachment, an outline of the cutout being formed along the inner shape of the legs and the connecting portion.

10. A side release buckle, comprising:

(a) a socket comprising:

(i) a belt attachment; and (ii) a body associated with the belt attachment, the body comprising a top surface and a spaced apart bottom surface, wherein outer portions of the top surface are connected by a relatively narrow central portion of the top surface that is recessed relative to the outer portions of the top surface, wherein outer portions of the bottom surface are connected by a relatively narrow central portion of the bottom surface that is recessed relative to the outer portions of the bottom surface, and wherein at least parts of the central portions are spaced closer together than the outer portions of the top and bottom surfaces; and (b) a plug comprising a belt attachment and a pair of resilient legs, the legs configured to insert into the body of the socket such that the socket and plug are engaged.

11. The side release buckle of claim 10, wherein the plug further comprises a guide extending between the legs along an insertion direction.

12. The side release buckle of claim 11, wherein the guide of the plug and at least one of the central portions of the socket are configured to interact in a sliding fashion during insertion of the plug into the socket along the insertion direction.

13. The side release buckle of claim 10, wherein the central portions of the top and bottom surfaces of the socket comprise undulations.

14. The side release buckle of claim 13, wherein the undulations each comprise a linear concave outer surface and a linear convex inner surface.

15. The side release buckle of claim 10, wherein, when the plug and socket are engaged, the central portions of the top and bottom surfaces are positioned between the legs of the plug.

16. The side release buckle of claim 10, wherein the socket further comprises a first cutout area between the top surface and the belt attachment and a second cutout area between the bottom surface and the belt attachment, wherein the second cutout area is larger than the first cutout area.

17. The side release buckle of claim 16, wherein each leg of the plug comprises an engaging portion proximate a tip of the leg; and wherein the socket further comprises four engaged portions configured to engage the engaging portions of the plug when the socket and plug are engaged.

18. The side release buckle of claim 17, wherein two of the engaged portions of the socket are inset relative an edge of the first cutout area and the other two of the engaged portions of the socket are proximate an edge of the second cutout area.

19. The side release buckle of 16, wherein the plug further comprises a connecting portion extending between the legs and connected proximate the tips of the legs, the connecting portion defining an at least partially open area partially surrounded by the connecting portion; and, wherein, when the plug and socket are engaged, the first and second cutout areas of the socket at least partially overlap the open area of the plug.

20. A side release buckle, comprising:

(b) a plug comprising:

(i) a belt attachment;

(ii) a pair of resilient legs, each leg including an engaging portion proximate a tip of the leg; and (iii) a connecting portion connected proximate the tip of each leg, at least a portion of the connecting portion defining a u shape, the connecting portion defining an at least partially open area partially surrounded by the connecting portion; and (b) a socket comprising:

(i) a belt attachment;

(ii) a body associated with the belt attachment, the body comprising a top surface and a spaced apart bottom surface, wherein outer portions of the top surface are connected by a relatively narrow central portion of the top surface that is recessed relative to the outer portions of the top surface, wherein outer portions of the bottom surface are connected by a relatively narrow central portion of the bottom surface that is recessed relative to the outer portions of the bottom surface, and wherein the central portions are spaced closer together than the outer portions of the top and bottom surfaces; and (iii) a first cutout area between the top surface and the belt attachment and a second cutout area between the bottom surface and the belt attachment, wherein the second cutout area is larger than the first cutout area.

* * * * *

UNITED STATES PATENT AND TRADEMARK OFFICE

CERTIFICATE OF CORRECTION

PATENT NO. : 8,522,409 B2
APPLICATION NO. : 13/647341
DATED : September 3, 2013
INVENTOR(S) : Ryoichiro Uehara et al.

It is certified that error appears in the above-identified patent and that said Letters Patent is hereby corrected as shown below:

In the Specification:

In column 1, line 23, delete “packages)” and insert --packages).--, therefor.

Signed and Sealed this
Tenth Day of December, 2013

Margaret A. Focarino

Margaret A. Focarino
*Commissioner for Patents of the United States Patent and Trademark Office*